United States Patent [19]

Whipps

[11] 4,402,776

[45] Sep. 6, 1983

[54] SILICON-CONTAINING COMPOSITIONS FOR SELF-SUSTAINED INTERMETALLIC REACTIONS

[75] Inventor: Patrick A. Whipps, Tuscon, Ariz.

[73] Assignee: Hughes Aircraft Company, El Segundo, Calif.

[21] Appl. No.: 180,270

[22] Filed: Aug. 22, 1980

[51] Int. Cl.[3] ..... C06B 43/00

[52] U.S. Cl. ..... 149/108.2; 250/493.1; 75/254

[58] Field of Search ..... 149/108.2; 250/493.1; 75/254

[56] References Cited

U.S. PATENT DOCUMENTS

| | | | |
|---|---|---|---|
| 2,775,514 | 12/1956 | Wainer | 149/108.2 |
| 3,305,326 | 2/1967 | Longo | 149/108.2 |
| 3,503,814 | 3/1970 | Helms et al. | 149/108.2 |
| 3,587,467 | 6/1971 | Menke et al. | 149/108.2 |
| 3,690,849 | 9/1972 | Bredzs et al. | 149/108.2 |

OTHER PUBLICATIONS

Hardt et al. (I), *Combustion and Flame,* 21, 77–89, (1973).

Hardt et al. (II), ibid, 91–97.

*Primary Examiner*—Edward A. Miller

*Attorney, Agent, or Firm*—David W. Collins; W. J. Bethurum; A. W. Karambelas

[57] ABSTRACT

A compacted mixture of heat-generating powders including about 1 to 20 weight percent of silicon results in improved heat transfer to unreacted components or to the ambient during condensed state exothermic reaction to form intermetallic products. Gettering of expanding gases from impurities and incomplete compaction is also provided by the silicon addition, thereby increasing overall heat conductivity of the compact and further improving the heat transfer rate from the reacted region.

3 Claims, No Drawings

SILICON-CONTAINING COMPOSITIONS FOR SELF-SUSTAINED INTERMETALLIC REACTIONS

BACKGROUND OF THE INVENTION

1. Field of the Invention

The invention relates to compositions suitable for use in heat-generating reactions, and, more particularly, to improved compositions which are capable of undergoing exothermic reactions in the condensed state to form intermetallic products.

2. Description of the Prior Art

Mixtures of certain elemental metal and metalloid powders are known to be capable of reacting in a self-sustaining manner at high temperatures to form intermetallic products. Such heat-generating reactions generally proceed without the formation of a gaseous species, either as a product or intermediate or by boiling or decomposition of a reactant. Examples of condensed state compositions evidencing an exothermic reaction are given in Vol. 21, Combustion and Flame, pp. 77–89, 91–97 (1973). A number of compositions are disclosed, including boron and carbon mixtures with titanium and zirconium.

Sustainer and booster compositions which undergo heat-generating reactions are employed in, e.g., ordnance and pyrotechnic devices. A sustainer is a composition formulated without significant compromise toward sensitivity (ease of initiation). A booster is a composition having greater sensitivity, permitting its use as an intermediate step in initiation between a sustainer and a convenient first fire, such as an electrical initiator.

During condensed state reaction of a compacted mixture of heat-generating powders, heat transfer may be hampered by an overall increase in compact void fraction due to expansion of entrapped gases and vaporized impurities. This is detrimental in booster compositions, since empirical evidence shows that certainty of sustainer reaction is proportional to the heat transfer rate between the igniter and sustainer compositions. A reduction of heat transfer in sustainer compositions is also detrimental, since such reduction can lead to incomplete reaction.

SUMMARY OF THE INVENTION

In accordance with the invention, the heat transfer properties of both booster and sustainer compositions are improved by providing such compositions with about 1 to 20% (by weight) of silicon.

The presence of silicon in booster compositions retards volume expansion by gettering expanding gases which are generated by impurities and as a result of incomplete compaction. Further, silicon melts before other components and is therefore useful as a heat conductor to transfer heat to unreacted portions of the booster composition and to transfer heat from booster to sustainer compositions.

Sustainer compositions are usually formed as compact slabs of pressed (pelletized) powders. In some applications, the sustainer composition is held against a slab or pellet of another material such as graphite. In such situations, the sustainer composition is ignited and undergoes an exothermic reaction, providing heat to the graphite slab which in turn emits radiation which may be detected. The heat transfer between the sustainer composition and emitter composition is improved by providing silicon at the sustainer/emitter interface.

The desired amount of silicon may be mixed throughout igniter compositions in instances when its gettering capability is desired. On the other hand, when it is desired to improve wetting action of a sustainer composition to an emitter composition and thus provide improved conduction of heat, the desired amount of silicon may be deposited on one surface of the sustainer composition prior to pelletizing. The silicon-enriched surface is then maintained against a surface of the emitter material.

DETAILED DESCRIPTION OF THE INVENTION

Silicon additions to compacted powder mixtures comprising a booster composition improve the heat transfer rate from the booster composition to a sustainer composition during condensed state reaction. Silicon additions also improve the heat transfer rate from a sustainer composition to the ambient during reaction. In the case of thermal beacons, for example, the ambient is a slab of graphite which is heated by the sustainer composition to a temperature sufficient to generate infrared radiation, which may then be detected by a suitable detector.

Silicon additions in accordance with the invention improve the compact heat conductivity in two ways. Once heat generation begins, silicon begins to melt and thus provides a conduction path between reacted and unreacted regions of the compact. In addition, the molten silicon getters much of the undesirable expanding gases and greatly reduces the volume expansion of the compact. This further improves the heat conduction between reacted and unreacted regions.

Silicon additions to such heat-generating compositions are efficacious over the range of about 1 to 20 weight percent of silicon, based on the total composition. Less than about 1% silicon does not provide adequate gettering action, while greater than about 20% silicon results in unacceptably reduced available heat to melt the silicon. Preferably, the amount of silicon added ranges from about 3 to 10% for sustainer compositions and about 7 to 10% for booster compositions. Such amounts of silicon substantially reduce compact volume expansion. Certainty of sustainer reaction is also improved.

The types of condensed state reaction systems which are beneficially improved by the silicon addition of the invention include reactive metal-metalloid compositions, where the reactive metal is at least one element selected from the group consisting of titanium, zirconium, hafnium and vanadium, and preferably titanium, and the metalloid is at least one member selected from the group consisting of boron, carbon and boron carbide ($B_4C$). Examples of such compositions include $TiB_2$, $TiC_{0.78}$ and $Ti(B_4C)_{0.305}$. These compositions are typically near stoichiometric, but may have a slight excess of reactive metal up to about 10 weight percent in excess of stoichiometric ratios. Upon heating a compacted mixture of powders of the constituents to a sufficiently high temperature, a self-sustaining condensed state exothermic reaction occurs, which forms an intermetallic product.

Preferred compositions improved by the invention consist essentially of about 67 to 79 weight percent titanium, 13 to 30 weight percent $B_4C$, up to about 10 weight percent carbon and up to about 10 percent boron. The carbon and/or boron additions may be made to improve ease of initiation or mechanical strength. The carbon may be in crystalline form, such as graphite, or amorphous form, such as lampblack, or a combination of both. An example of a preferred composition to which silicon may be added includes 75.9% Ti, 16.7% $B_4C$, 3.7% graphite and 3.7% lampblack.

The final composition preferably consists essentially of (a) a composition within the range listed above for preferred compositions plus (b) about 1 to 20 weight percent silicon, based on the total composition.

An example of a booster composition of the invention includes 71% Ti, 16% $B_4C$, 6% C and 7% Si. An example of a sustainer composition of the invention includes 69% Ti, 24% $B_4C$ and 7% Si.

Additions of silicon in accordance with the invention may be made throughout the heat-generating composition in order to improve gettering of gases. Alternatively, the desired amount of silicon may be deposited on top of the heat-generating powder prior to compaction. In the latter case, this would be done, for example, to improve wettability and heat conduction to a graphite slab, and consequently, the silicon-enriched side would be placed in direct contact with the graphite slab.

The silicon is desirably added in powder form, less than +200 mesh (Tyler). Otherwise, a poor dispersal of silicon throughout the compact is obtained. Preferably, smaller particle sizes are employed.

EXAMPLES

A series of booster and sustainer compacts containing no silicon or containing silicon in amounts within or outside the scope of the invention were prepared from powders of the constituents. These compositions are listed in Table I.

TABLE I

| Compositions (Percent by Weight) and Type | | | | | |
|---|---|---|---|---|---|
| Example | Ti | $B_4C$ | C | Si | Type |
| 1 | 76 | 17 | 7(c) | — | Sustainer |
| 2 | 64 | 28 | 4(a) | 4 | Booster |
| 3 | 71 | 16 | 6(a) | 7 | Booster |

TABLE I-continued

| Compositions (Percent by Weight) and Type | | | | | |
|---|---|---|---|---|---|
| Example | Ti | $B_4C$ | C | Si | Type |
| 4 | 69 | 24 | — | 7 | Sustainer |
| 5 | 66 | 14 | 3(a) | 17 | Booster |
| 6 | 58 | 12 | — | 30 | Sustainer |

Note:
(c) = crystalline carbon
(a) = amorphous carbon

The perimeter and thickness (in inches) of the compacts were measured before and after solid state reaction. These results are tabulated in Table II.

TABLE II

| Measurements of Compacts Before and After Solid State Reaction | | | | | |
|---|---|---|---|---|---|
| | Perimeter, in. | | Thickness, in. | | Gettering |
| Example | Before | After | Before | After | Capability |
| 1 | 4.4 | 4.5 | 0.250 | 0.320 | Fair |
| 2 | (not available) | | 0.206 | 0.340 | Fair |
| 3 | 4.4 | 4.5 | 0.210 | 0.270 | Good |
| 4 | 4.4 | 4.4 | 0.210 | 0.220 | Excellent |
| 5 | 4.4 | 4.5 | 0.210 | 0.270 | Good |
| 6 | 4.4 | 3.8 | 0.210 | 0.200 | Poor |

As seen from Table II, silicon additions reduce the extent of volume expansion. Such reduction in volume expansion is a measure of the gettering capability of silicon. Too much silicon resulted in a decrease in volume after ignition. Although amorphous carbon (lampblack) contributed to substantial volume expansion, additions of silicon to compositions containing amorphous carbon resulted in a significant decrease in volume expansion.

I claim:

1. An improved composition capable of generating an exothermic reaction in the condensed state consisting essentially of (a) about 67 to 79 weight percent titanium, about 13 to 30 weight percent boron carbide, up to about 10 weight percent carbon, and up to about 10 weight percent boron plus (b) about 1 to 20 weight percent silicon, based on the total composition.

2. The composition of claim 1 in which the amount of silicon ranges from about 3 to 10%.

3. The composition of claim 1 in which the amount of silicon ranges from about 7 to 10%.

* * * * *